United States Patent [19]

Peter

[11] 4,156,441

[45] May 29, 1979

[54] YARN TENSIONER FOR WEAVING MACHINES

[75] Inventor: Erich Peter, Lindau, Fed. Rep. of Germany

[73] Assignee: Lindauer Dornier Gesellschaft mbH, Fed. Rep. of Germany

[21] Appl. No.: 886,341

[22] Filed: Mar. 14, 1978

[51] Int. Cl.[2] ..... D03D 47/36

[52] U.S. Cl. ..... 139/452

[58] Field of Search ..... 66/132; 139/435, 452, 139/450; 226/7, 95, 168; 242/47.01, 47.04, 47.06, 47.12

[56] References Cited

U.S. PATENT DOCUMENTS

| | | | |
|---|---|---|---|
| 3,411,548 | 11/1968 | Pfarrwaller | 139/452 |
| 3,672,590 | 6/1972 | Rosen | 242/47.12 |
| 3,995,786 | 12/1976 | Deniega | 139/452 |

FOREIGN PATENT DOCUMENTS

| | | | |
|---|---|---|---|
| 2031995 | 11/1970 | France | 139/452 |

*Primary Examiner*—Henry Jaudon
*Attorney, Agent, or Firm*—James E. Bryan

[57] ABSTRACT

This invention relates to a yarn tensioner for weaving machines in which a filling is intermittently removed from a supply spool by means of a filling insertion mechanism, comprising annular brush means loosely surrounding a rotatable drum means with a smooth surface, means whereby said brush means is mounted on said drum means so as to be freely displaceable within an axially limited range, a first, fixed yarn guiding eyelet means mounted between the supply spool and the drum means, said first eyelet means being adapted to feed a yarn along an approximately axial direction to said drum means, and a second and also fixed yarn guiding eyelet means mounted at the other end of said drum means and adapted to forward said yarn in an approximately axial direction, said yarn when being between said two yarn guiding eyelet means passing on the surface of said drum means and underneath said brush means.

7 Claims, 4 Drawing Figures

YARN TENSIONER FOR WEAVING MACHINES

The invention relates to a yarn tensioner for weaving machines.

The filling to be inserted into weaving machines is taken off, filling by filling, from large yarn supply spools mounted outside the machines on a special structure or creel. The nature of filling insertion entails that the filling is alternatingly taken off at high speed within short time intervals and then supposedly remains at rest. However, because of inertia, the filling taken off of the spool cannot be immediately stopped. While yarn-braking systems are conventionally installed between the supply spool and the filling insertion mechanism for instance a gripper, which do becalm the yarn and always cause some yarn tension for the purpose of insertion feeding, and which ensure satisfactory seizure of the yarn by the filling insertion mechanism, these yarn-brakes cannot seize the yarn earlier than, if then, behind the guide eyelet of the spool or bobbin creel, —when seen in the direction of motion of the yarn —, so that the yarn from bobbin to the guide eyelet remains undecelerated and slack.

This slack hanging yarn depending on material and torque tends to twist, which may interfere with the subsequent filling insertion.

The invention therefore addresses the problem of avoiding these drawbacks and to ensure there will be no twisting. This problem is solved by the invention by mounting an annular brush freely displaceable within an axially limited range in such a manner on a rotating drum with a smooth surface that the brush surrounds the drum, and by mounting a first fixed guide eyelet between the supply spool and the drum, which feeds the yarn to the drum along an approximately axial direction, and a second yarn-guiding eyelet, also fixed, at the other end of the drum, which forwards the yarn in the approximately axial direction, the yarn within the region between the two guiding eyelets passing on the drum surface but under the brush. Because of the light pressure from the brush, the slack yarn is formed into a loop wound on the drum and tensioned in the process. Advantageously, the bristles of the annular brush are so arranged that they are at an angle or are slanted with respect to the direction of rotation of the drum. In a further embodiment of the invention, the second yarn guiding eyelet is mounted at a distance from the axis of rotation of the drum which is less than the drum radius.

One embodiment of the invention will be described in much simplified form with reference to the accompanying drawing, in which.

Figure 3:
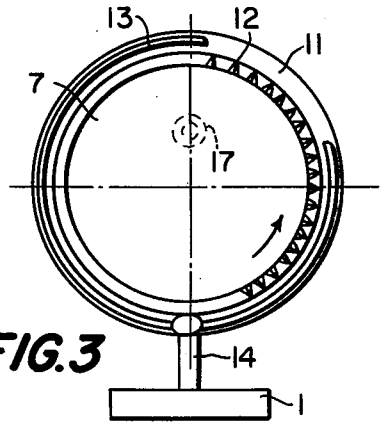
FIG. 3 is an elevation of the yarn tensioner of FIG. 2 in the axial direction.

The design and arrangement of the yarn tensioner will be first explained with reference to FIG. 1. The filling 21 from a supply spool or bobbin V passes through a yarn guiding eyelet 15 to the yarn tensioner S. Thereupon, the yarn is made to pass through a second yarn guiding eyelet 17 to a yarn brake B and then to a filling insertion mechanism indicated here as a gripper rod G. The yarn supply to the yarn tensioner S, and further guidance, essentially takes place in the axial direction. The yarn brake B is always set for the same value. If there were no yarn tensioner S, the resulting slack filling between the supply spool V and the yarn brake B might twist. A drum 7 on which is mounted on annular brush 11 is an essential component of the yarn tensioner S, both the drum and the brush being indicated schematically. These components will be discussed more specifically with reference to the following FIGS.

Figure 2:
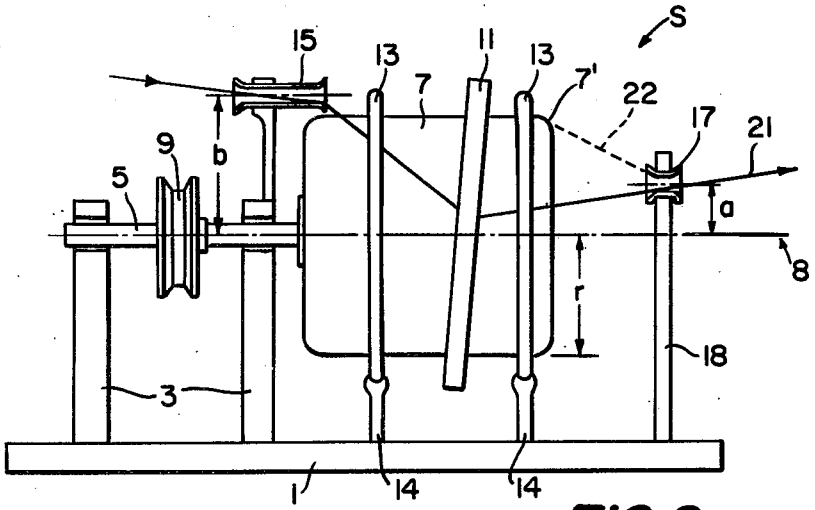
FIG. 2 is a side view of the yarn tensioner.

FIG. 2 also shows in much simplified form the design of the yarn tensioner S. The shaft 5 of a drum 7 rests in the supports 3, themselves resting on a base plate or supporting arm 1. The drive for the drum 7 in this instance is illustrated as a belt drive in the form of a pulley 9. The drum 7 with a smooth surface rests on the shaft 5. An annular brush 11 surrounds the drum 7. The brush 11 lies loosely on the surface of the drum 7; furthermore the brush may be freely moved in the axial direction within given limits. These limits are determined by the rings 13 shown in FIG. 2, which are mounted to the base plate 1 through the intermediary of the braces 14; other embodiments than rings are possible. In lieu of closed rings, other limit-members such as bails or the like may be provided.

Figure 4:
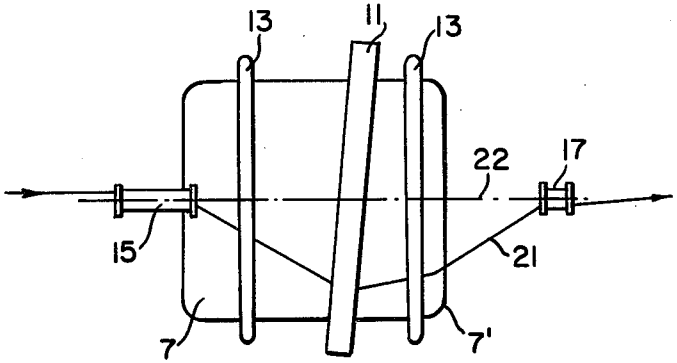
FIG. 4 is a top view of the yarn tensioner.

A first yarn guiding eyelet 15 is mounted to the left of the drum 7, in the direction of the supply spool (not shown). The guiding eyelet may be mounted to one of the supports 3 or to the base plate 1. A second guiding eyelet is also rigidly mounted at the right end of the drum 7; it is denoted by 17. The radial spacing b between the first guiding eyelet 17 and the rotational axis 8 is at least as large as the radius r of the drum 7, or somewhat larger. This is to ensure that the yarn will not be pulled over the edge of the drum 7. To that end, the exit aperture of the yarn guiding eyelet 15, if necessary, may be displaced sufficiently in the axial direction that the aperture is still located above the surface of the drum 7, as indicated in FIGS. 2 and 4. The yarn 21 further is made to pass on the drum surface underneath the bristles of the annular brush 11 and into the second yarn guiding eyelet 17 at the other end of the drum 7. The spatial arrangement of this second yarn guiding eyelet 17 is so chosen that the yarn 21 is guided along the direction indicated by the arrow over the edge 7′ of the drum 7. To that end the spacing a between the yarn guiding eyelet 17 and the axis of rotation 8 of the drum 7 is selected smaller than radius r of the drum 7. The edge 7′ of the drum 7 is rounded to prevent damaging the thread.

Figure 1:
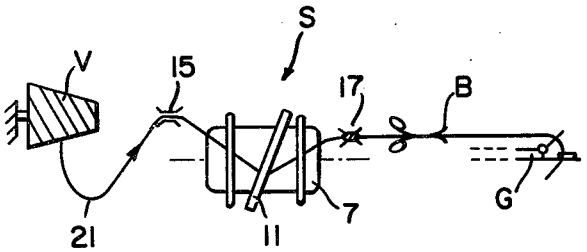
FIG. 1 is a schematic arrangement of the yarn tensioner at a weaving machine.

FIG. 3 shows the yarn tensioner S of FIG. 1 in axial elevation, viewed from the right. The drum 7 is surrounded by a ring 13 which is solidly mounted through brace 14 to the base plate 1. The ring is interrupted at one place in the drawing to better show the arrangement of the annular brush 11. The bristles 12 are shown on part of the circumference of the brush 11 and loosely touch the surface of the drum 7. As already mentioned, it is advantageous to direct the bristles somewhat at a slant with respect to the direction of rotation of the drum 7 as indicated by an arrow. The position of the second yarn guiding eyelet 17 is shown in phantom.

The functioning of the yarn tensioner will now be described with reference to FIGS. 2 and 4, FIG. 4 being a top view of the representation of FIG. 2. When the yarn tensioner is in the rest position, the filling 21 is made to pass in the direction of the arrow through the first yarn guiding eyelet 15 to the surface of the drum 7 and passes on the drum surface, underneath the annular brush 11, on to the second yarn guiding eyelet 17. Because of its tensioning, the yarn 21 follows the shortest path between the two yarn guiding eyelets 15 and 17. The filling will be tensioned as long as it is taken off of the supply spool and inserted by the appropriate mechanism into the shed. This remains essentially the case also when the drum 7 is rotating. This is so because of the very smooth drum surface and the very slight brush pressure arising from the bristles being at a slant with respect to the direction of rotation of the drum. The moment the filling insertion is interrupted, and the associated yarn tension drops —whether during a filling transfer or at the end of the filling insertion at the outside of the weaving machine —the undecelerated section of filling between the supply spool and the brake will continue to unwind because of the masses in motion, and because of the slight pressure exerted by the brush, the yarn section being carried along by the rotating drum continuing to unwind because of the masses in motion and thereby forming into a flat loop corresponding to the solid line shown drawn into the FIGS. The slack yarn between the spool and the brake thereby is tensioned to such an extent that on one hand twisting is prevented and on the other hand no further yarn is removed from the spool in spite of the tension. The moment the length of the loop is wound on the drum 7, the annular brush 11 maintains the yarn 21 in its present position despite the continued rotation of drum 7, the yarn being deflected at the brush 11 and from there arriving at the second yarn guiding eyelet 17. The moment the filling 21 is removed at the right from the second yarn guiding eyelet 17—upon the subsequent filling insertion—the yarn segment lying on the drum will be stretched, regardless of any further rotation of this drum 7, and be returned to the position 22 shown in dashed lines. The particular magnitude of yarn deflection on the drum always corresponds to the instantaneous length of the loop formed by inertia. The yarn deflection on the drum 7 takes place by itself. Therefore the tension in the yarn remains the same after each removal.

The size or length of the loop wound on the drum is of subordinate significance with respect to the essence of the invention; care merely must be paid that the coilings of the fillings on the drum can be smoothly removed therefrom upon the subsequent filling insertion. This assuredly will be the case when the drum dimensions, i.e., the drum radius, is so chosen that even the longest possible yarn loop that may occur in operation can be reliably wound on less than half a drum circumference. But even several yarn windings on the drum are permissible, provided care is taken that the take-off speed of the yarn through the filling insertion mechanism, upon filling insertion, exceeds the peripheral speed of the drum.

It will be obvious to those skilled in the art that many modifications may be made within the scope of the present invention without departing from the spirit thereof, and the invention includes all such modifications.

What is claimed is:

1. A yarn tensioner for weaving machines in which a filling is intermittently removed from a supply spool by means of a filling insertion mechanism, comprising annular brush means loosely surrounding a rotatable drum means with a smooth surface, means whereby said brush means is mounted on said drum means so as to be freely displaceable within an axially limited range, a first, fixed yarn guiding eyelet means mounted between the supply spool and the drum means, said first eyelet means being adapted to feed a yarn along an approximately axial direction to said drum means, and a second and also fixed yarn guiding eyelet means mounted at the other end of said drum means and adapted to forward said yarn in an approximately axial direction, said yarn when being between said two yarn guiding eyelet means passing on the surface of said drum means and underneath said brush means.

2. A yarn tensioner according to claim 1 including means mounting the first yarn guiding eyelet means at a distance from the axis of rotation of said drum means which is greater than the radius of the drum means.

3. A yarn tensioner according to claim 2 in which the drum means projects axially beyond the intake aperture of the first yarn guiding eyelet means.

4. A yarn tensioner according to claim 1 including means mounting the second yarn guiding eyelet means at a distance from the axis of rotation of the drum means which is less than the radius of the drum means.

5. A yarn tensioner according to claim 1 including fixed means bounding the range of displacement of the annular brush means.

6. A yarn tensioner according to claim 1 in which the edge of the drum means is rounded and buffed at least at the exit side of the yarn.

7. A yarn tensioner according to claim 1 in which the bristles of the annular brush means are slanted against the direction of rotation of the drum means.

* * * * *